US010670987B1

(12) United States Patent
Iguchi

(10) Patent No.: US 10,670,987 B1
(45) Date of Patent: Jun. 2, 2020

(54) IMAGE FORMING APPARATUS AND ESTIMATION METHOD THAT ESTIMATE A REMAINING AMOUNT OF TONER

(71) Applicant: TOSHIBA TEC KABUSHIKI KAISHA, Shinagawa-ku, Tokyo (JP)

(72) Inventor: Ken Iguchi, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/565,735

(22) Filed: Sep. 10, 2019

(51) Int. Cl.
*G03G 15/08* (2006.01)

(52) U.S. Cl.
CPC ..... *G03G 15/0856* (2013.01)

(58) Field of Classification Search
CPC ..... G03G 15/553; G03G 15/0856; G03G 15/0831; G03G 2215/0888
USPC ..... 399/27, 61
See application file for complete search history.

(56) References Cited

U.S. PATENT DOCUMENTS 9,268,283 B1 * 2/2016 Sugiyama ..... G03G 15/553

FOREIGN PATENT DOCUMENTS

JP 2009-150964 7/2009

* cited by examiner

*Primary Examiner* — William J Royer
(74) *Attorney, Agent, or Firm* — Amin, Turocy & Watson, LLP

(57) ABSTRACT

According to one embodiment, an image forming apparatus includes a printer unit and a control unit. The printer unit forms an image on a sheet using a developer, and includes a predetermined driving member related to supply of the developer. The control unit acquires driving information regarding continuous driving of the driving member, acquires correction information regarding on correction of an amount of the developer used in accordance with the driving information, and estimates a remaining amount of the developer on the basis of the driving information and the correction information.

20 Claims, 7 Drawing Sheets

| CONTINUOUS DRIVING TIME | CORRECTION VALUE |
|---|---|
| 0ms～200ms | 100 |
| 201ms～400ms | 100 |
| 401ms～600ms | 100 |
| 601ms～700ms | 100 |
| 701ms～800ms | 100 |
| 801ms～900ms | 98 |
| 901ms～1000ms | 96 |
| 1001ms～1100ms | 93 |
| 1101ms～1200ms | 90 |
| ... | ... |

FIG. 8

| CONTINUOUS DRIVING TIME | CORRECTION TARGET TIME | CORRECTION VALUE |
|---|---|---|
| 0ms～200ms | 0 | 100 |
| 201ms～400ms | 0 | 100 |
| 401ms～600ms | 0 | 100 |
| 601ms～700ms | 0 | 100 |
| 701ms～800ms | 0 | 100 |
| 801ms～900ms | 1ms～100ms | 98 |
| 901ms～1000ms | 101ms～200ms | 96 |
| 1001ms～1100ms | 201ms～300ms | 93 |
| 1101ms～1200ms | 301ms～400ms | 90 |
| ... | ... | ... |

IMAGE FORMING APPARATUS AND ESTIMATION METHOD THAT ESTIMATE A REMAINING AMOUNT OF TONER

FIELD

Embodiments described herein relate generally to an image forming apparatus and an estimation method.

BACKGROUND

There are image forming apparatuses that estimate a remaining amount of toner accommodated in a toner cartridge. Various techniques for estimating a remaining amount of toner are examined. For example, there is a technique for estimating a remaining amount of toner on the basis of a rotation time of a toner supply motor, and the like. However, in this technique, an increase in a continuous rotation time of the toner supply motor may result in an increase in a deviation between an actual remaining amount of toner and an estimation result.

DESCRIPTION OF THE DRAWINGS

FIG. 8 is a diagram showing a second specific example of a toner use amount correction table.

DETAILED DESCRIPTION

In general, according to one embodiment, an image forming apparatus includes a printer unit and a control unit. The printer unit forms an image on a sheet using a developer, and includes a predetermined driving member related to supply of the developer. The control unit acquires driving information regarding continuous driving of the driving member, acquires correction information regarding on correction of an amount of the developer used in accordance with the driving information, and estimates a remaining amount of the developer on the basis of the driving information and the correction information.

Figure 1:
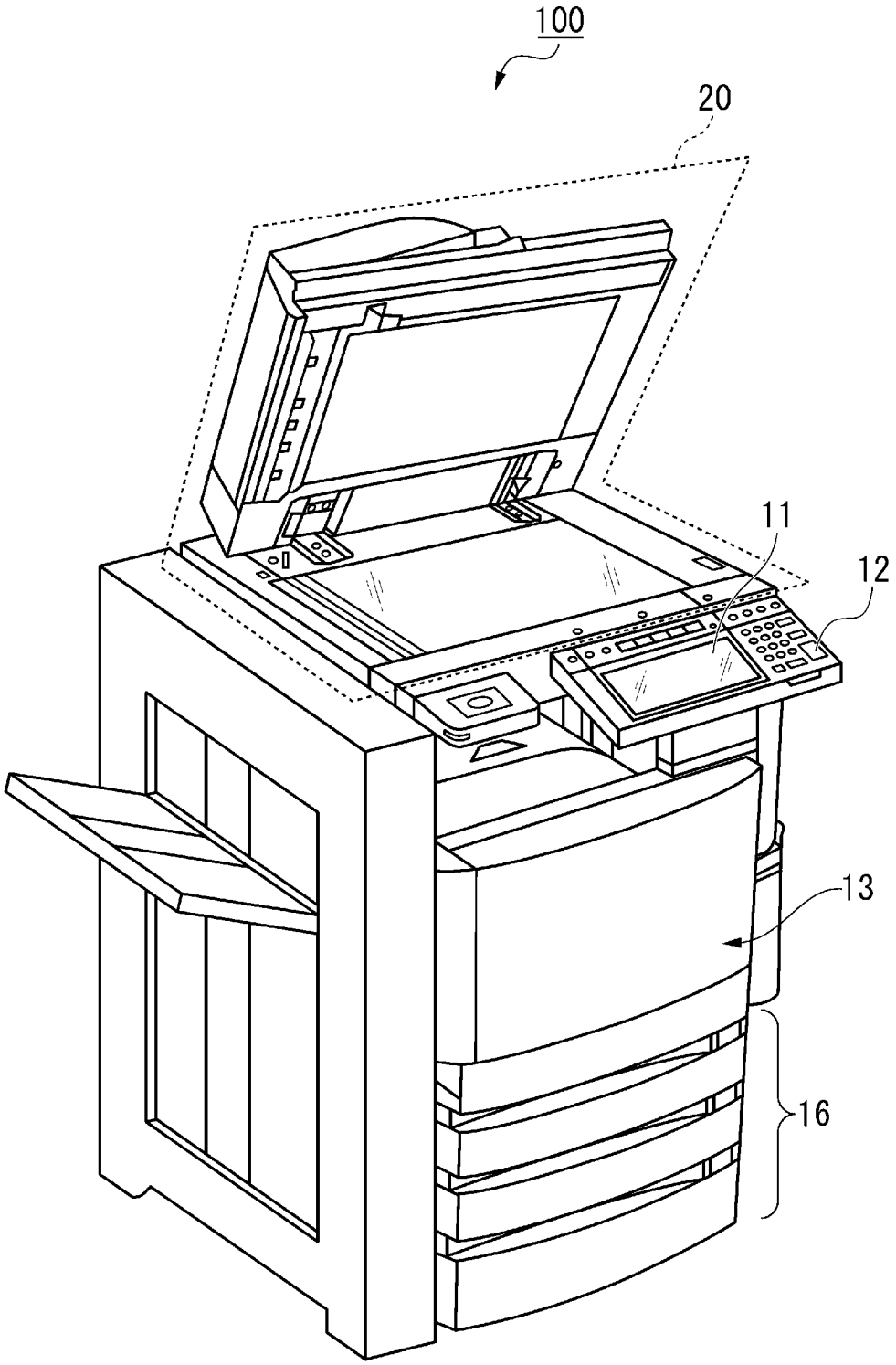
FIG. 1 is an exterior diagram showing an overall configuration example of an image forming apparatus according to an embodiment.

FIG. 1 is an exterior diagram showing an overall configuration example of an image forming apparatus 100 according to an embodiment. The image forming apparatus 100 is, for example, a multi-function printer. The image forming apparatus 100 includes a display 11, a control panel 12, a printer unit 13, a sheet accommodation portion 16, and an image reading unit 20.

The printer unit 13 of the image forming apparatus 100 forms an image on a sheet using a developer such as a toner. The sheet is, for example, paper or a label sheet. The sheet may be anything as long as the image forming apparatus 100 can form an image on the surface of the sheet.

Figure 2:
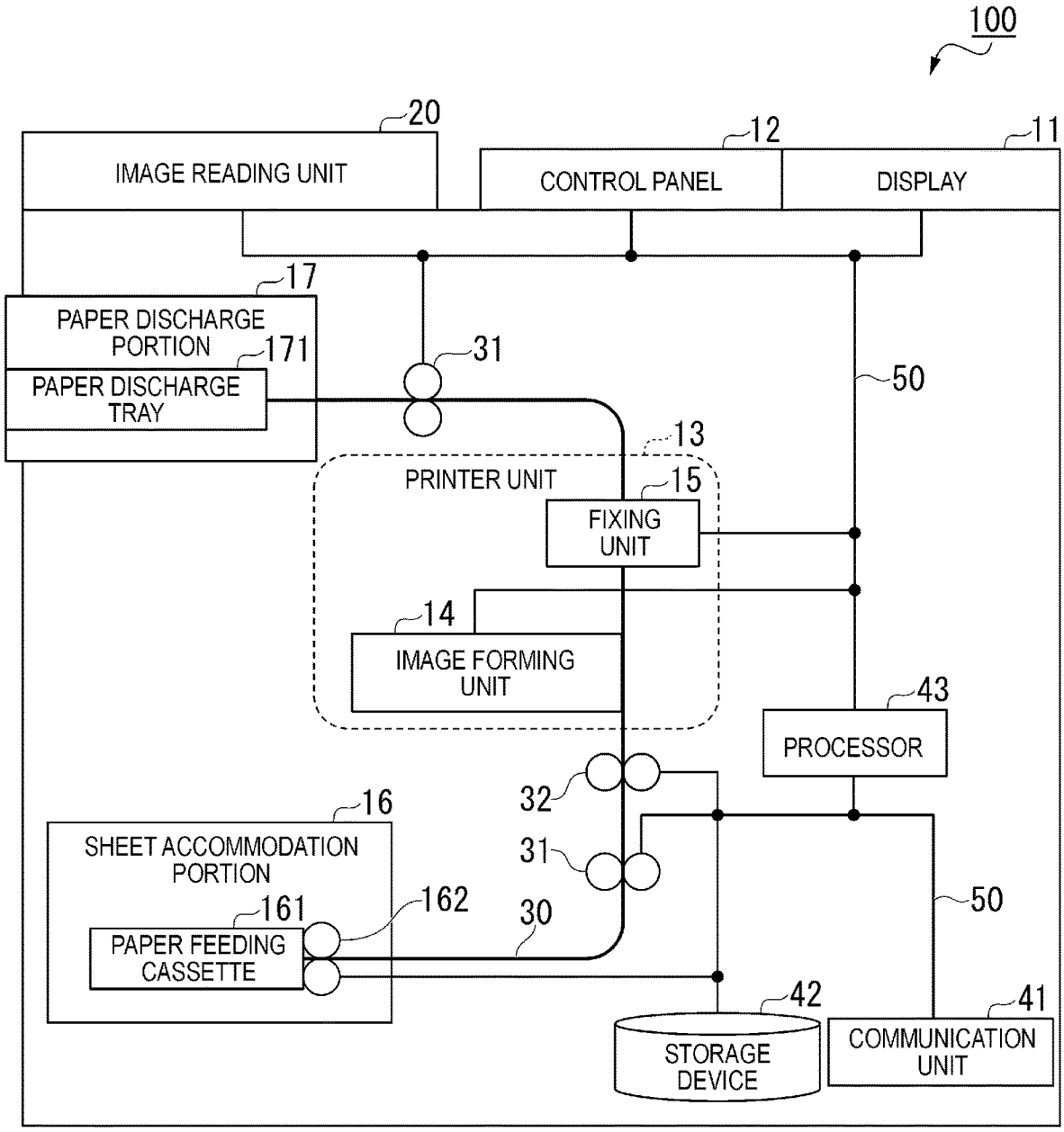
FIG. 2 is a block diagram showing a hardware configuration of the image forming apparatus.

FIG. 2 is a block diagram showing a hardware configuration of the image forming apparatus 100 according to the embodiment. The image forming apparatus 100 includes the display 11, the control panel 12, the printer unit 13, the sheet accommodation portion 16, a paper discharge portion 17, the image reading unit 20, a transport roller 31, a resist roller 32, a communication unit 41, a storage device 42, and a processor 43. The functional units of the image forming apparatus 100 are connected to each other so as to be capable of performing data communication through a system bus 50.

The display 11 is an image display apparatus such as a liquid crystal display or an organic electro luminescence (EL) display. The display 11 displays various pieces of information regarding the image forming apparatus 100.

The control panel 12 includes a plurality of buttons. The control panel 12 receives a user's operation. The control panel 12 outputs a signal based on an operation performed by the user to a control unit of the image forming apparatus 100. Meanwhile, the display 11 and the control panel 12 may be configured as an integrated touch panel.

The printer unit 13 includes an image forming unit 14 and a fixing unit 15. The printer unit 13 forms an image on a sheet on the basis of image information generated by the image reading unit 20 or image information received through a communication path. For example, the printer unit 13 forms an image through the following process. The image forming unit 14 of the printer unit 13 forms an electrostatic latent image on a photoreceptor drum on the basis of image information. The image forming unit 14 of the printer unit 13 forms a visible image by attaching a developer to the electrostatic latent image. A specific example of the developer is a toner. A transfer unit (not shown) of the printer unit 13 transfers the visible image on a sheet. The fixing unit 15 of the printer unit 13 fixes the visible image onto the sheet by performing heating and pressurization on the sheet. Meanwhile, the sheet having the image formed thereon may be a sheet accommodated in the sheet accommodation portion 16 or may be a manually inserted sheet. Hereinafter, description will be given on the assumption that the developer is a toner.

Figure 3:
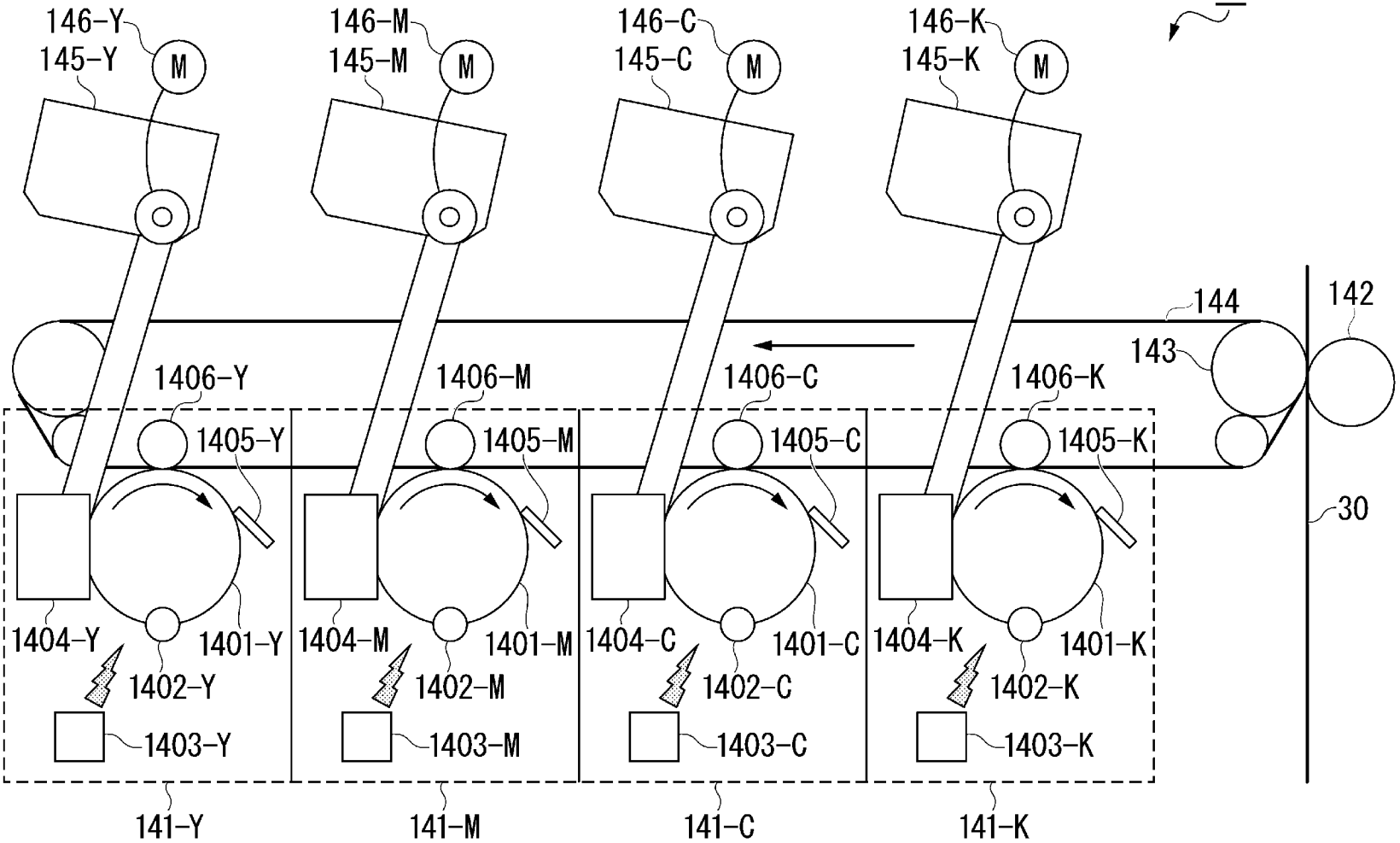
FIG. 3 is a diagram showing a configuration example of an image forming unit.

FIG. 3 is a diagram showing a configuration example of the image forming unit 14 according to the embodiment. The image forming unit 14 according to the embodiment forms images of four colors of yellow, magenta, cyan, and black. The image forming unit 14 includes a processing unit 141, a secondary transfer roller 142, an opposite secondary transfer roller 143, an intermediate transfer belt 144, a toner cartridge 145, and a toner supply motor 146. The image forming unit 14 includes the processing unit 141, the toner cartridge 145, and the toner supply motor 146 for each color. In the image forming unit 14, the above-described functional units corresponding to four colors are distinguished as Y, M, C, and K. Y represents yellow. M represents magenta. C represents cyan. K represents black. For example, 141-Y represents the processing unit 141 for yellow. Hereinafter, description will be given by simply referring to processing units, toner cartridges, and toner supply motors as the processing unit 141, the toner cartridge 145, and the toner supply motor 146, respectively, when it is not necessary to make a distinction therebetween.

The processing unit 141 forms a toner image on the intermediate transfer belt 144 which is an endless belt. The processing unit 141 includes a photoreceptor drum 1401, a charger 1402, an exposure apparatus 1403, a developing apparatus 1404, a photoreceptor cleaner 1405, and a primary transfer roller 1406. All of the processing units 141 of four colors of Y, M, C and K have the same configuration.

The photoreceptor drum 1401 generates an electrostatic latent image on its own surface. The photoreceptor drum 1401 is an image carrier. The photoreceptor drum 1401 is, for example, a columnar drum. The photoreceptor drum 1401 has a photoreceptor material on the outer peripheral surface thereof. The photoreceptor drum 1401 has a material discharging static electricity to a portion irradiated with light.

The charger 1402 charges the surface of the photoreceptor drum 1401 with static electricity. The charger 1402 is, for example, a needle electrode. The exposure apparatus 1403 forms an electrostatic latent image of an image to be formed on the surface of the photoreceptor drum 1401. The exposure apparatus 1403 is, for example, a laser irradiation apparatus. The developing apparatus 1404 supplies a toner to the surface of the photoreceptor drum 1401. The developing apparatus 1404 develops the electrostatic latent image using the toner. The photoreceptor cleaner 1405 removes a residual toner on the photoreceptor drum 1401. The removed toner is collected in a waste toner tank (not shown). The removed toner is discarded. The primary transfer roller 1406 transfers the toner image developed on the surface of the photoreceptor drum 1401 to the intermediate transfer belt 144.

The secondary transfer roller 142 transfers the toner image formed on the intermediate transfer belt 144 onto a sheet. The opposite secondary transfer roller 143 is provided at a position facing the secondary transfer roller 142. The opposite secondary transfer roller 143 and the secondary transfer roller 142 interpose the transported sheet. The toner image is transferred onto the sheet interposed between the secondary transfer roller 142 and the opposite secondary transfer roller 143. The secondary transfer roller 142 and the opposite secondary transfer roller 143 rotate to transport the sheet onto which the toner image is transferred.

The image forming unit 14 includes toner cartridges 145 filled with toners of respective colors for each processing unit 141. The image forming unit 14 includes the toner cartridges 145 of four colors of Y, M, C and K. The toner cartridge 145 is filled with a toner corresponding to each color. In the image forming unit 14, for example, 145-Y represents a yellow toner cartridge. A toner transport member transporting a toner while rotating is included in the toner cartridge 145 in order to transport the toner toward a toner discharge port. The toner transport member is, for example, a rotatable member having a screw-like blade around a rotation shaft. The toner supply motor 146 rotates the toner transport member in response to a rotation instruction received from the processor 43. The toner transport member is rotated in association with the rotation of the toner supply motor 146. The toner drops into the developing apparatus 1404 through a pipe toward the toner discharge port of the toner cartridge in association with the rotation of the toner transport member. In the developing apparatus 1404, a toner is supplied. The toner supply motor 146 is one mode of a driving member. The driving member is a member related to the supply of a developer. Returning to FIG. 2, the description of the image forming apparatus 100 is continued. The sheet accommodation portion 16 includes a paper feeding cassette 161 and a paper feeding roller 162. The paper feeding cassette 161 of the sheet accommodation portion 16 accommodates a sheet used to form an image in the printer unit 13. The paper feeding roller 162 rotates in response to a rotation instruction received from the processor 43. The sheet accommodated in the paper feeding cassette 161 is transported to the printer unit 13 in association with the rotation of the paper feeding roller 162. Meanwhile, a transport path of the transported sheet is represented by a transport path 30.

The paper discharge portion 17 includes a paper discharge tray 171. A sheet discharged from the image forming apparatus 100 is disposed in the paper discharge tray 171. For example, a sheet transported from the sheet accommodation portion 16 through the transport path 30 is discharged from the paper discharge tray 171.

The image reading unit 20 reads image information to be read as brightness and darkness of light. The image reading unit 20 records the read image information. The recorded image information may be transmitted to another information processing apparatus through a network. The recorded image information may be formed as an image on a sheet by the printer unit 13.

The transport roller 31 rotates in response to a rotation instruction received from the processor 43. The transport roller 31 rotates to transport a sheet. The resist roller 32 makes a sheet inclined in the middle of transport horizontal. The resist roller 32 rotates in response to a rotation instruction received from the processor 43. The resist roller 32 rotates to transport the sheet made horizontal.

The communication unit 41 is configured using a communication interface. The communication unit 41 communicates with an external apparatus (for example, a management server) through a network using a predetermined protocol.

The storage device 42 is configured using a storage device such as a magnetic hard disk device or a semiconductor storage device. The storage device 42 stores data required when the image forming apparatus 100 operates. The storage device 42 stores data, such as a remaining amount of toner, which is used by the functional units included in the image forming apparatus 100. The storage device 42 may store digital data generated by the image reading unit 20. The storage device 42 may store data of an image formed in the image forming apparatus 100.

Figures 4, 5:
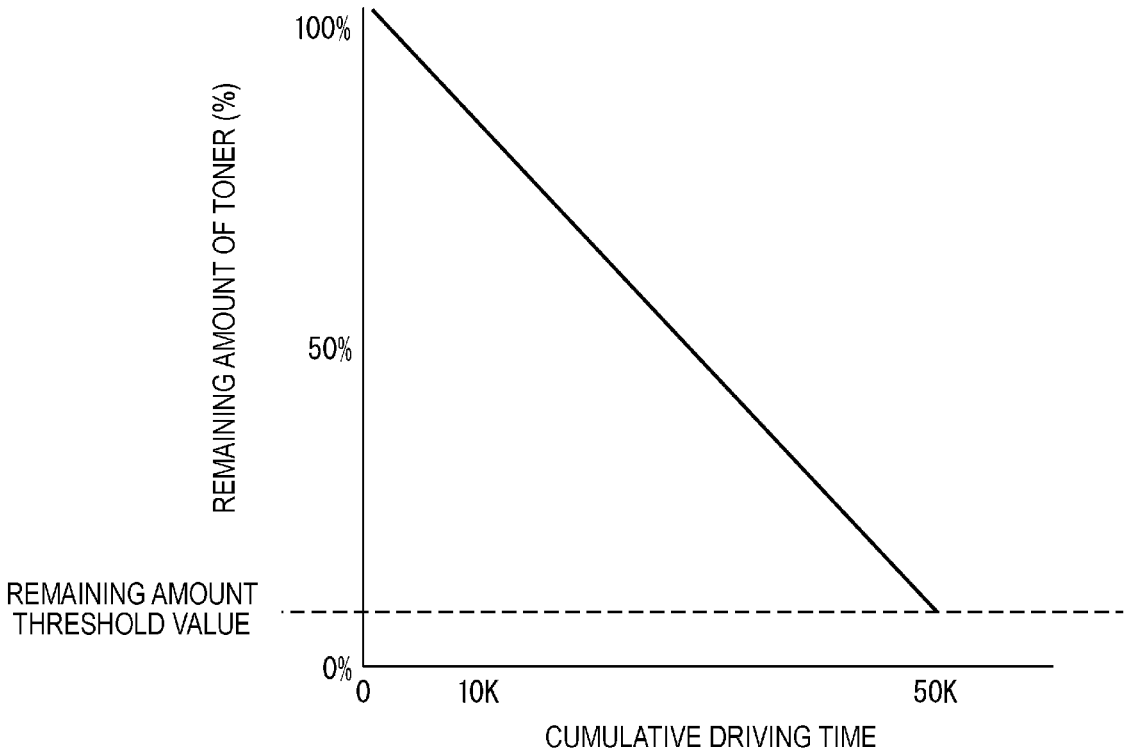
FIG. 4 is a diagram showing a specific example of a toner use amount correction table.
FIG. 5 is a diagram showing a specific example of a relationship between a remaining amount of toner and a cumulative motor driving time.

The storage device 42 stores, for example, a toner use amount correction table. The toner use amount correction table shows correction values for the amount of toner used corresponding to continuous driving times of the toner supply motor 146. FIG. 4 is a diagram showing a specific example of a toner use amount correction table according to the embodiment. The toner use amount correction table has values of continuous driving times and correction values. The continuous driving time is a time for which the toner supply motor 146 is continuously driven. The correction value is a value which is used for the correction of the amount of toner used. The continuous driving times and the correction values are stored in association with each other. The amount of toner used is calculated on the basis of a continuous driving time of the toner supply motor 146 and a correction value associated with the continuous driving time. Meanwhile, the values of the toner use amount correction table are not limited to the values shown in FIG. 4. The toner use amount correction table may have values varying depending on the model of the image forming apparatus 100 or the use state of a user. The continuous driving time is one mode of driving information. The driving information is information regarding continuous driving of the driving member. The correction value is one mode of correction information. The correction information is information regarding the amount of the developer used.

Returning to FIG. 2, the description of the image forming apparatus 100 is continued. The storage device 42 stores a remaining amount threshold value related to a remaining amount of toner. When the remaining amount of toner is less than the remaining amount threshold value, it is determined that the remaining amount of toner is in a near empty state. The near empty indicates that a toner accommodated in the toner cartridge is decreasing. The remaining amount threshold value may be 10% or 20%. The remaining amount threshold value may be a value determined in advance.

The processor 43 controls operations of the functional units of the image forming apparatus 100. The processor 43 is, for example, a central processing unit (CPU) or the like. The processor 43 executes processing by loading a software program stored in the storage device 42 onto a memory such as a RAM and executing the software program.

The processor 43 detects that, for example, a toner accommodated in the toner cartridge is in a near empty state. The processor 43 estimates a remaining amount of toner on the basis of the amount of toner used. The processor 43 detects whether or not a toner is in a near empty state on the basis of the estimated remaining amount of toner. For example, the processor 43 calculates the amount of toner used on the basis of a driving time of the toner supply motor 146. For this reason, the remaining amount of toner and the toner supply motor 146 have a fixed relationship.

FIG. 5 is a diagram showing a specific example of a relationship between a remaining amount of toner and a cumulative motor driving time according to the embodiment. As shown in FIG. 5, when a cumulative driving time of the toner supply motor 146 is 0, a remaining amount of toner is 100%. The processor 43 reduces a remaining amount of toner inside the toner cartridge in response to an increase in the cumulative driving time of the toner supply motor 146. The processor 43 sets a toner near empty state when a remaining amount of toner is less than a remaining amount threshold value stored in the storage device 42.

Figure 6:
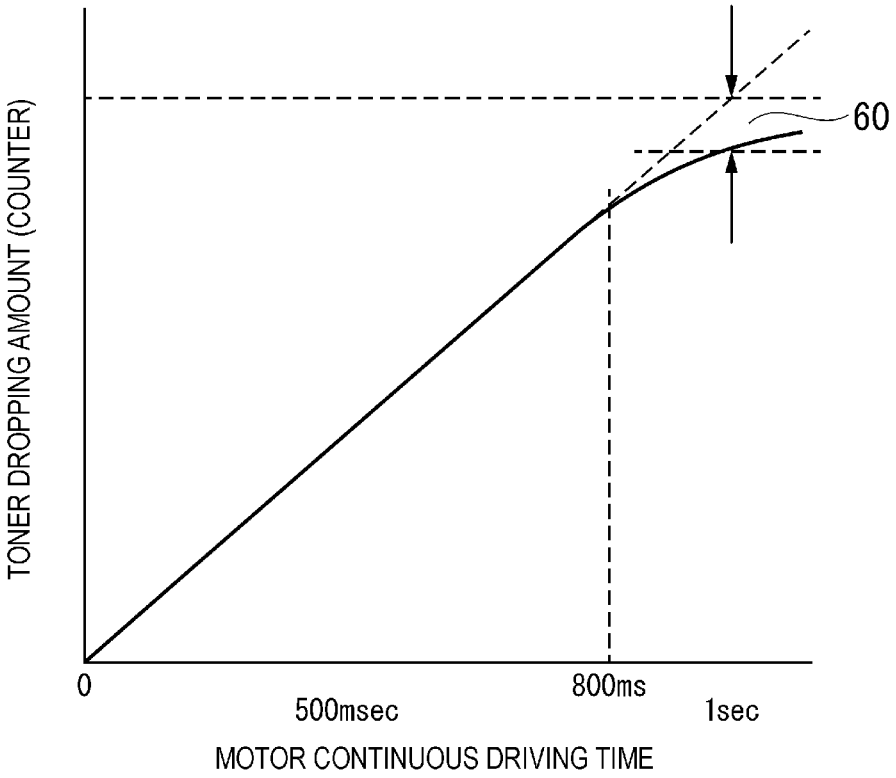
FIG. 6 is a diagram showing a specific example of a relationship between a toner dropping amount and a motor continuous driving time of the image forming apparatus.

FIG. 6 is a diagram showing a specific example of a relationship between a toner dropping amount and a motor continuous driving time of the image forming apparatus 100 according to the embodiment. FIG. 6 includes a region 60. The region 60 is a difference between an expected dropping amount based on a driving time of the toner supply motor 146 and an actual toner dropping amount. The expected dropping amount is indicated by a dashed line. The actual toner dropping amount is indicated by a solid line. According to FIG. 6, when a continuous driving time of the toner supply motor 146 is equal to or less than 800 ms, the continuous driving time and the toner dropping amount of the toner supply motor 146 have a linear relationship. In addition, when the continuous driving time is equal to or less than 800 ms, the expected dropping amount and the actual toner dropping amount are equal to each other. When the continuous driving time of the toner supply motor 146 becomes longer than 800 ms, the toner dropping amount decreases. The toner dropping amount decreases with decompression inside the toner cartridge accompanying dropping of a toner. For this reason, when the continuous driving time becomes longer than 800 ms, the actual toner dropping amount becomes smaller than the expected dropping amount. Meanwhile, in FIG. 6, a case where the toner dropping amount decreases when the continuous driving time becomes longer than 800 ms is described, but the value is not limited to 800 ms. A continuous driving time in which a toner dropping amount decreases may be longer than 800 ms or may be shorter than 800 ms. The continuous driving time in which a toner dropping amount decreases is a time when a relationship between a driving time of the toner supply motor 146 and a toner dropping amount is not linear. The continuous driving time in which a toner dropping amount decreases is one mode of a threshold value.

When the image forming apparatus 100 is used such that one toner supply time becomes equal to or less than 800 ms, there is a low possibility that a deviation may occur in the estimation of a remaining amount of toner. The use of the image forming apparatus such that one toner supply time becomes equal to or less than 800 ms means that, for example, printing having a low printing rate is used. When the image forming apparatus 100 is used such that one toner supply time becomes longer than 800 ms, a deviation may occur in the estimation of a remaining amount of toner. The use of the image forming apparatus such that one toner supply time becomes longer than 800 ms means that, for example, printing having a high printing rate is used.

When the processor 43 estimates a remaining amount of toner with a linear relationship regardless of the length of a continuous driving time, the processor 43 may estimate that the amount of toner is smaller than an actual remaining amount of toner. For example, as the number of times the image forming apparatus is used such that one toner supply time becomes longer than 800 ms increases, the processor 43 more estimates that the amount of toner is smaller than an actual remaining amount of toner. Therefore, the processor 43 determines that a near empty state is set even when a remaining amount of toner inside the toner cartridge is equal to or greater than a remaining amount threshold value. When the toner cartridge is replaced at a timing when it is determined that a near empty state is set, a toner remaining in the toner cartridge is wasted.

For this reason, the processor 43 calculates the amount of toner used on the basis of the continuous driving time of the toner supply motor 146 and the toner use amount correction table stored in the storage device 42. For example, a case where the toner supply motor 146 is continuously driven for 600 ms will be described. In this case, the processor 43 acquires a correction value in which a continuous driving time is associated with 600 ms from the toner use amount correction table stored in the storage device 42. The correction value in which a continuous driving time is associated with 600 ms is 100. The processor 43 multiplies the continuous driving time of 600 ms by a value obtained by dividing 100 which is a correction value by 100. The processor 43 counts 600 which is a value obtained by the multiplication as the amount of toner used. The processor 43 may estimate a remaining amount of toner by subtracting the calculated amount of toner used from the present remaining amount of toner. In addition, the processor 43 may estimate the latest remaining amount of toner by adding the calculated amount of toner used to the present amount of toner used.

Next, a case where the toner supply motor 146 is continuously driven for 1000 ms will be described. In this case, the processor 43 acquires a correction value in which a continuous driving time is associated with 1000 ms from the toner use amount correction table stored in the storage device 42. The correction value in which a continuous driving time is associated with 1000 ms is 96. The processor 43 multiplies the continuous driving time of 1000 ms by a value obtained by dividing the correction value of 96 by 100. The processor 43 counts 960 which is a value obtained by the multiplication as the amount of toner used. The processor 43 may estimate a remaining amount of toner by subtracting the calculated amount of toner used from the present remaining amount of toner. The processor 43 may estimate the latest remaining amount of toner by adding the calculated amount of toner used to the present amount of toner used.

Figure 7:
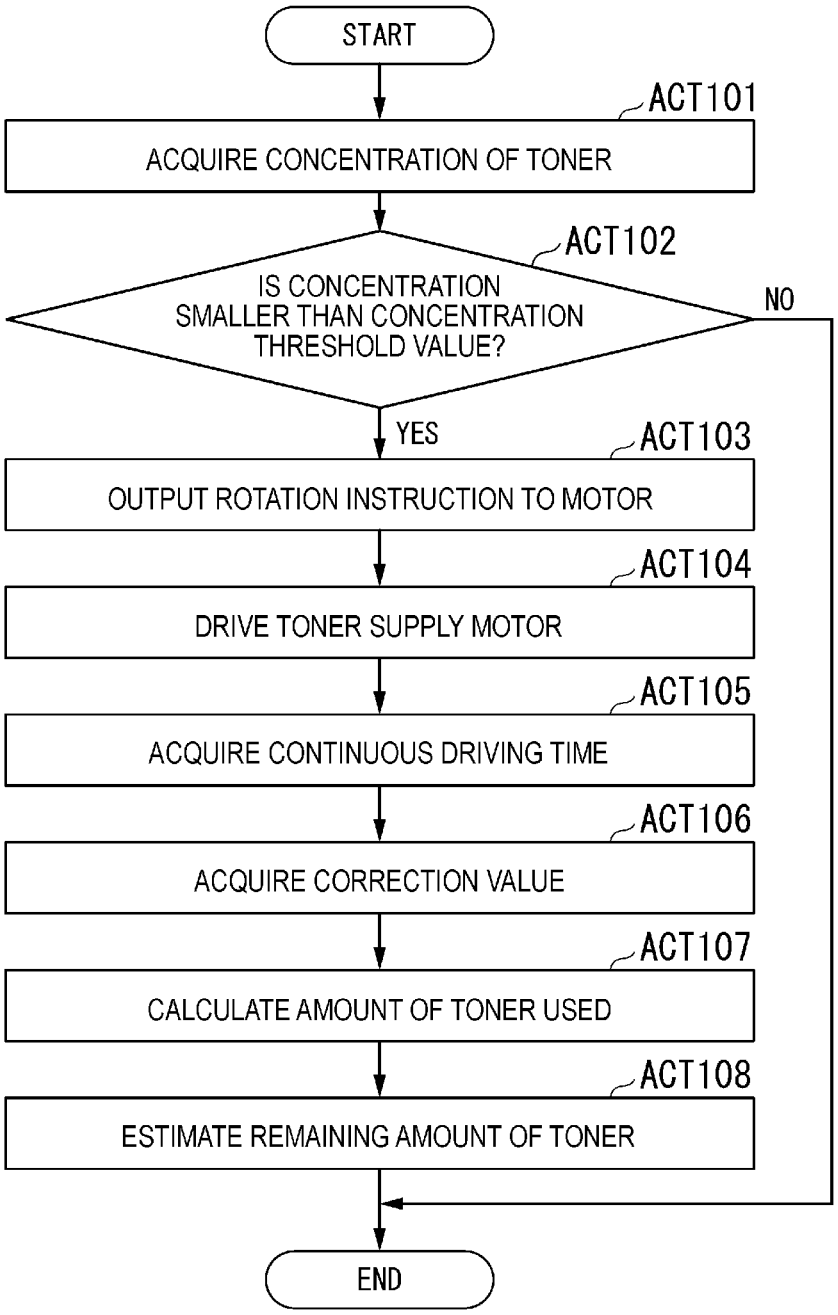
FIG. 7 is a flowchart showing a specific example of a flow of a process of estimating a remaining amount of toner.

FIG. 7 is a flowchart showing a specific example of a flow of a process of estimating a remaining amount of toner according to the embodiment. The processor 43 performs a toner supply operation by driving the toner supply motor 146. The processor 43 detects that the toner cartridge is empty in response to the fact that the concentration of a toner is not increased in spite of the execution of the toner supply operation. The processor 43 estimates a remaining amount of toner until the toner cartridge becomes empty on the basis of a driving time of the toner supply motor 146. Meanwhile, in FIG. 7, description will be given on the assumption that the toner cartridge is not empty. A process of estimating a remaining amount of toner is performed at a predetermined timing. The predetermined timing may be, for example, a timing when an image forming process is terminated. The predetermined timing may be, for example, a timing when an image is formed on a sheet.

The processor 43 acquires a concentration of a toner inside the developing apparatus 1404 (ACT101). Specifically, the processor 43 acquires the concentration of the toner from an automatic toner sensor (ATS) (not shown) included in the developing apparatus 1404. The ATS is a sensor that detects the concentration of a toner.

The processor 43 determines whether or not the acquired concentration is smaller than a concentration threshold value related to a concentration (ACT102). Specifically, the processor 43 acquires the concentration threshold value related to a concentration from the storage device 42. The processor 43 compares the concentration threshold value related to a concentration with the acquired concentration. When the acquired concentration is equal to or greater than the concentration threshold value (ACT102: NO), the processor 43 terminates the process. In this case, the processor 43 sets a previously estimated remaining amount of toner to be the latest remaining amount of toner. The processor 43 may record the remaining amount of toner in the storage device 42.

When the acquired concentration is smaller than the concentration threshold value (ACT102: YES), the processor 43 outputs a rotation instruction to the toner supply motor 146 (ACT103). Specifically, the processor 43 determines a driving time of the toner supply motor 146. The processor 43 may determine a driving time of the toner supply motor 146 on the basis of, for example, driving times associated with concentrations. In this case, the storage device 42 stores the driving times associated with the concentrations in advance. In addition, the processor 43 may determine a driving time determined in advance as a driving time of the toner supply motor 146. In these cases, the processor 43 outputs the rotation instruction and the driving time to the toner supply motor 146. In addition, the processor 43 may drive the toner supply motor 146 until the acquired concentration becomes equal to or greater than the threshold value. In this case, the processor 43 outputs the rotation instruction to the toner supply motor 146. The processor 43 outputs a stop instruction to the toner supply motor 146 when the acquired concentration becomes equal to or greater than the concentration threshold value. The processor 43 measures a driving time of the toner supply motor 146. Meanwhile, the processor 43 may set a difference between a time when the rotation instruction is output and a time when the stop instruction is output to be a driving time of the toner supply motor 146.

The toner supply motor 146 is driven by receiving the rotation instruction (ACT104). Specifically, the toner supply motor 146 is driven in response to the rotation instruction received from the processor 43. For example, when a driving time is received from the processor 43, the toner supply motor 146 is driven on the basis of the received driving time. For example, when the driving time is not received from the processor 43, the toner supply motor 146 is driven until the stop instruction is received from the processor 43.

The processor 43 acquires a continuous driving time (ACT105). Specifically, when the processor 43 outputs the rotation instruction and the driving time to the toner supply motor 146, the processor acquires the output driving time as a continuous driving time. On the other hand, when the processor 43 does not output a driving time to the toner supply motor 146, the processor acquires a measured driving time of the toner supply motor 146 as a continuous driving time.

The processor 43 acquires a correction value (ACT106). Specifically, the processor 43 acquires the toner use amount correction table stored in the storage device 42. The processor 43 acquires a correction value associated with the acquired continuous driving time.

The processor 43 calculates the amount of toner used on the basis of the continuous driving time and the correction value (ACT107). Specifically, the processor 43 calculates a ratio related to a decrease in a toner dropping amount by dividing the correction value by 100. The processor 43 calculates the amount of toner used by multiplying the continuous driving time by the calculated ratio. For example, the processor 43 calculates the amount of toner used on the basis of the following expression.

$$\text{Continuous driving time} \times \text{Correction value} \div 100 = \text{Amount of toner used}$$

The processor 43 estimates a remaining amount of toner (ACT108). Specifically, the processor 43 acquires a remaining amount of toner from the storage device 42. The processor 43 subtracts the calculated amount of toner used from the remaining amount of toner. The processor 43 estimates the remaining amount of toner obtained by the subtraction as a latest remaining amount of toner. The processor 43 records the estimated remaining amount of toner in the storage device 42.

In the image forming apparatus 100 configured in this manner, the processor 43 acquires a continuous driving time of the toner supply motor 146 and a correction value associated with the continuous driving time. The processor 43 estimates a remaining amount of toner on the basis of the continuous driving time and the correction value. For this reason, the image forming apparatus 100 can bring the estimated value of the remaining amount of toner into closer to an actual amount of toner accommodated in the toner cartridge. Therefore, a maintenance person of the image forming apparatus 100 can reduce a residual toner in the toner cartridge accompanying the replacement of the toner cartridge. In addition, the maintenance person of the image forming apparatus 100 can supply the toner cartridge in a state closer to an empty state to a user of the image forming apparatus 100 and can reduce a service cost.

Modification Example

In the above-described embodiment, the processor 43 calculates the amount of toner used by multiplying a continuous driving time by a correction value. However, the processor 43 may calculate the amount of toner used using another method. For example, the processor 43 may calculate the amount of toner used on the basis of another toner use amount correction table. FIG. 8 is a diagram showing a second specific example of the toner use amount correction table according to the embodiment. The second specific example of the toner use amount correction table has values of continuous driving times, correction target times and correction values. Since the continuous driving times and the correction values are the same as those in the above-described embodiment, description thereof will be omitted. The correction target time is a driving time of the toner supply motor 146 which is corrected using a correction value. The correction target time is a value obtained by subtracting a continuous driving time when a toner dropping amount decreases (hereinafter, referred to as a "dropping decrease time") from the continuous driving time. Meanwhile, regarding the correction target time, 0 is a lower limit value. The processor 43 corrects the amount of toner used on the basis of a correction value with respect to a continuous driving time corresponding to a time after a dropping decrease time. Hereinafter, description will be given on the assumption that a dropping decrease time is 800 ms. First, when a continuous driving time is equal to or less than 800 ms, a correction target time is 0 ms. However, when the continuous driving time is longer than 800 ms, the processor 43 performs correction on a time after 800 ms. Specifically, the processor 43 calculates a ratio related to a decrease in a toner dropping amount by dividing a correction value by 100. The processor 43 calculates the amount of toner used by multiplying a dropping decrease time, a correction target time, and calculated ratio by each other. For example, the processor 43 calculates the amount of toner used on the basis of the following expression.

Dropping decrease time (800 ms)+Correction target time×Correction value÷100=Amount of toner used Next, a case where a continuous driving time is 1000 ms will be described. In this case, the processor 43 acquires 200 ms as a correction target time and acquires 96 as a correction value from the toner use amount correction table. The processor 43 calculates the amount of toner used on the basis of the acquired correction target time, correction value, and continuous driving time.

In the above-described embodiment, the processor 43 calculates the amount of toner used on the basis of a continuous driving time of the toner supply motor 146. However, the processor 43 may calculate the amount of toner used using another method. For example, the processor 43 may calculate the amount of toner used on the basis of a continuous rotational speed of the toner supply motor 146 instead of a continuous driving time. In this case, the storage device 42 stores the toner use amount correction table in which continuous rotational speeds and correction values are associated with each other.

The correction values of the toner use amount correction table may be arbitrarily changed through the control panel 12 or the communication unit 41. For example, a maintenance person of the image forming apparatus 100 may confirm the use state of the image forming apparatus 100 through a network. The maintenance person may determine an optimal correction value on the basis of the driving of the toner supply motor 146, the counting of the toner supply motor 146, and the state of image formation. The optimal correction value is one mode of change information. The optimum correction value is a value for bringing the amount of reduced toner of the cartridge and the calculated amount of toner used into closer to each other. In this case, the maintenance person inputs the optimal correction value by operating an external apparatus provided at a remote place such as a service center. The communication unit 41 of the image forming apparatus 100 acquires an optimal correction value which is input to the external apparatus. The processor 43 records the acquired correction value in the toner use amount correction table. In addition, the maintenance person may set an optimum correction value in the image forming apparatus 100 by operating the control panel 12.

In the above-described embodiment, the image forming apparatus 100 is configured to calculate the amount of toner used, but is not limited thereto. For example, the image forming apparatus may be configured to calculate the amount of toner used on the basis of an external apparatus. In this case, the image forming apparatus 100 transmits a continuous driving time to the external apparatus.

In the above-described embodiment, the image forming apparatus 100 is configured to estimate a remaining amount of toner, but is not limited thereto. For example, the image forming apparatus may be configured to estimate a remaining amount of toner on the basis of an external apparatus. In this case, the image forming apparatus 100 transmits the amount of toner used to the external apparatus.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the inventions.

What is claimed is:

1. An image forming apparatus, comprising:

a printer unit that forms an image on a sheet using a developer and includes a predetermined driving member related to supply of the developer; and a control unit that acquires driving information regarding continuous driving of the predetermined driving member, acquires correction information regarding a correction of an amount of the developer used in accordance with the driving information, and estimates a remaining amount of the developer based upon the driving information and the correction information.

2. The apparatus according to claim 1, wherein when the driving information is greater than a threshold value, the control unit acquires correction information in which an increment of the amount of the developer used becomes smaller than when the driving information is equal to or less than the threshold value.

3. The apparatus according to claim 2, wherein the control unit calculates the amount of the developer used based upon information calculated based upon the threshold value and a value obtained by multiplying a value obtained by subtracting information calculated based upon the threshold value from the driving information by the correction information on which a predetermined arithmetic operation related to a ratio is performed, and estimates a remaining amount of the developer based upon the amount of the developer used.

4. The apparatus according to claim 1, wherein the control unit calculates the amount of the developer used by multiplying the correction information on which a predetermined arithmetic operation related to a ratio is performed by the driving information and estimating a remaining amount of the developer on the basis of the amount of the developer used.

5. The apparatus according to claim 1, wherein the driving information includes a continuous driving time of the predetermined driving member.

6. The apparatus according to claim 1, wherein the predetermined driving member is a developer supply motor, and the driving information includes a continuous rotational speed of the predetermined driving member.

7. The apparatus according to claim 1, wherein the control unit acquires change information for changing correction information associated with the driving information and changes the correction information based upon the change information.

8. The apparatus according to claim 7, further comprising:

a control panel that receives an input of the change information, wherein the control unit changes the correction information based upon the input change information.

9. The apparatus according to claim 7, further comprising:

a communication unit that acquires the change information from an external apparatus, wherein the control unit changes the correction information based upon the acquired change information.

10. An estimation method executed by an image forming apparatus that forms an image on a sheet using a developer and includes a predetermined driving member related to supply of the developer, the estimation method comprising:

acquiring driving information regarding continuous driving of the predetermined driving member;

acquiring correction information regarding a correction of an amount of the developer used in accordance with the driving information; and estimating a remaining amount of the developer based upon the driving information and the correction information.

11. The method according to claim 10, further comprising:

when the driving information is greater than a threshold value, acquiring correction information in which an increment of the amount of the developer used becomes smaller than when the driving information is equal to or less than the threshold value.

12. The method according to claim 11, further comprising:

calculating the amount of the developer used based upon information calculated based upon the threshold value and a value obtained by multiplying a value obtained by subtracting information calculated based upon the threshold value from the driving information by the correction information on which a predetermined arithmetic operation related to a ratio is performed, and estimating a remaining amount of the developer based upon the amount of the developer used.

13. The method according to claim 10, further comprising:

calculating the amount of the developer used by multiplying the correction information on which a predetermined arithmetic operation related to a ratio is performed by the driving information and estimating a remaining amount of the developer on the basis of the amount of the developer used.

14. The method according to claim 10, wherein the driving information includes a continuous driving time of the predetermined driving member.

15. The method according to claim 10, wherein the driving information includes a continuous rotational speed of the predetermined driving member.

16. The method according to claim 10, further comprising:

acquiring change information for changing correction information associated with the driving information and changing the correction information based upon the change information.

17. The method according to claim 16, further comprising:

receiving an input of the change information; and changing the correction information based upon the input change information.

18. The method according to claim 16, further comprising:

acquiring the change information from an external apparatus; and changing the correction information based upon the acquired change information.

19. An image forming apparatus, comprising:

a printer unit that forms an image on a sheet using a toner and includes a toner supply motor;

a control unit that acquires driving information regarding continuous driving of the toner supply motor, acquires correction information regarding a correction of an amount of the toner used in accordance with the driving information, and estimates a remaining amount of the toner based upon the driving information and the correction information; and the control unit reduces a remaining amount of toner inside a toner cartridge in response to an increase in a cumulative driving time of the toner supply motor.

20. The apparatus according to claim 19, wherein the control unit sets a toner near empty state when the remaining amount of toner is less than a remaining amount threshold value.

* * * * *